United States Patent [19]

Schneider

[11] Patent Number: 4,664,039

[45] Date of Patent: May 12, 1987

[54] WRITING TABLE WITH ADJUSTABLE WORKING SURFACE AND ADJUSTABLE FOOTREST

[76] Inventor: Rudolf T. Schneider, Schweinfurter Str. 7, D-8742 Bad Königshofen, Fed. Rep. of Germany

[21] Appl. No.: 755,480

[22] Filed: Jul. 16, 1985

[30] Foreign Application Priority Data

Jul. 16, 1984 [DE] Fed. Rep. of Germany ... 8421248[U]

[51] Int. Cl.[4] ..... A47F 5/12

[52] U.S. Cl. ..... 108/6; 108/9; 297/439

[58] Field of Search ..... 108/6, 1, 7, 9; 297/172, 423, 439, 327, 328, 377, 21; 248/371

[56] References Cited

U.S. PATENT DOCUMENTS

| | | | |
|---|---|---|---|
| 1,652,774 | 12/1927 | Fraser et al. | 108/1 X |
| 1,986,399 | 1/1935 | Karsikas | 297/439 |
| 2,030,348 | 2/1936 | Barret | 100/6 X |
| 2,328,471 | 8/1943 | Leffer | 108/9 X |
| 2,571,139 | 10/1951 | Johnson | 297/377 |
| 2,891,350 | 6/1959 | Hansen | 108/93 X |
| 4,264,102 | 4/1981 | Sroub | 297/21 X |
| 4,539,977 | 9/1985 | Schneider, Sr. | 297/439 X |

FOREIGN PATENT DOCUMENTS

| | | | |
|---|---|---|---|
| 209718 | 12/1966 | Sweden | 108/7 |
| 9973 | of 1901 | United Kingdom | 108/9 |

*Primary Examiner*—Kenneth J. Dorner
*Assistant Examiner*—José V. Chen
*Attorney, Agent, or Firm*—Ostrolenk, Faber, Gerb & Soffen

[57] ABSTRACT

A writing table includes a writing surface countersunk into a working plate. Continuous adjustment of the inclination of the working surface towards a user from being coplanar with the working plate to a maximum angle is achieved through provision of a roller situated beneath a rear portion of the working surface. An adjustable footrest for the writing table that can be manipulated by a user's foot comprises a further roller, the ends of which are supported by left and right profile members having a desired adjustment profile.

7 Claims, 5 Drawing Figures

WRITING TABLE WITH ADJUSTABLE WORKING SURFACE AND ADJUSTABLE FOOTREST

BACKGROUND AND SUMMARY OF THE INVENTION

The present invention relates to a writing table or desk, and more particularly to a writing table with an adjustable working surface and adjustable footrest.

The principal object of the invention is to provide a writing table having a working surface that is adjustable from essentially flat to a very high angle of inclination.

A further object of the invention is to provide a writing table of the foregoing type in which there is additionally included a footrest that is adjustable both towards and away from a user and also up and down.

Another object of the invention is to provide a writing table having a working surface and a footrest adjustable as described above that is realized with simplicity of design and with uncomplicated adjustment features.

The foregoing objects are realized with a writing table having a working surface that may be inclined together with an adjustable foot support member. The writing table comprises a fixed working plate in which the working surface is countersunk so as to be coplanar with an upper surface of the working plate in one position of the working surface. Hinge means at the front of the working surface rotatably support the working surface with respect to the working plate. Support means support the rear of the working surface at different elevations above the plate. The support means comprise a table-roller situated beneath a rear portion of the working surface. The adjustable foot support includes a foot support member extending from left to right from the perspective of a user. Positioning means adjust the position of the foot support member towards and away from the user through manipulation of a foot support member towards and away from the user and also vertically through manipulation of the foot support member by a user's foot. In a preferred form, the positioning means comprises a pair of profile members respectively situated to the left and right of a user and a foot-roller. The ends of the foot-roller are adapted to rotate on the profile members under the force of a user's foot, and the foot-roller serves as a foot support member.

BRIEF DESCRIPTION OF THE DRAWINGS

The invention will be better understood and its various objects and advantages will be more fully appreciated from the following description taken in conjunction with the accompanying drawings.

DESCRIPTION OF THE PREFERRED EMBODIMENTS

Figure 2:
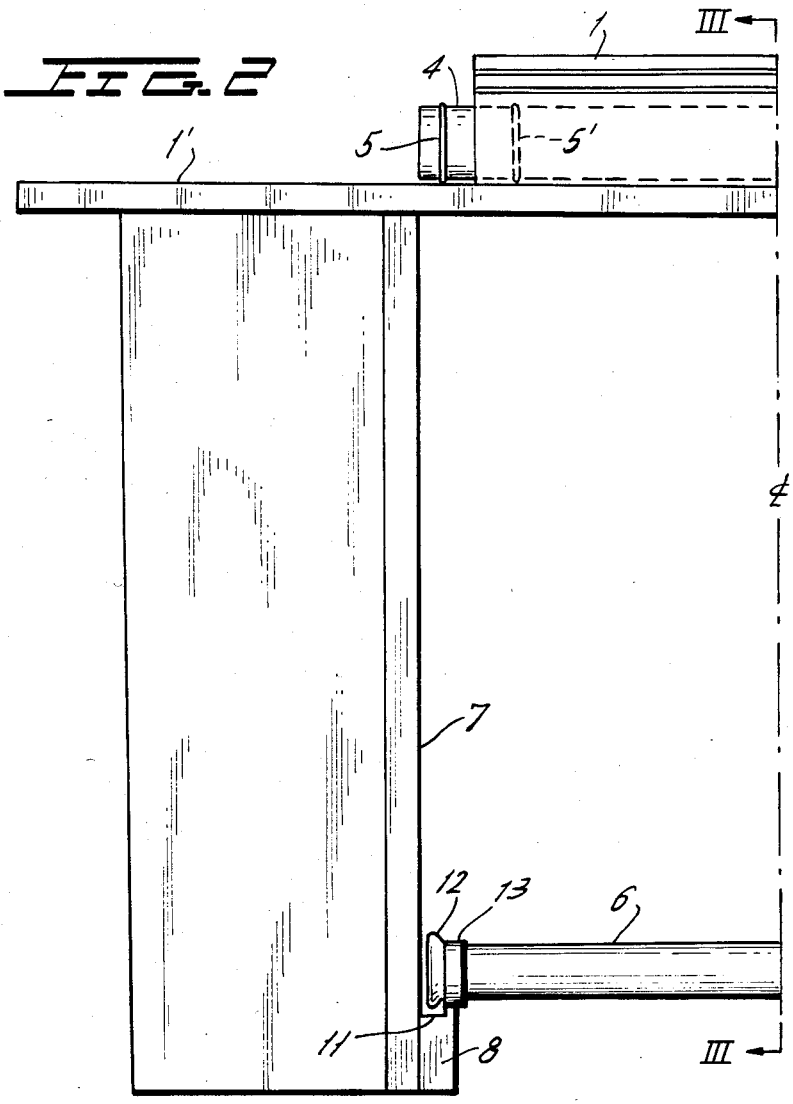
FIG. 2 is an enlarged front plan view of the writing table of FIGS. 1A–1C depicting only the portion of the table to the left of a center line.
Figure 3:
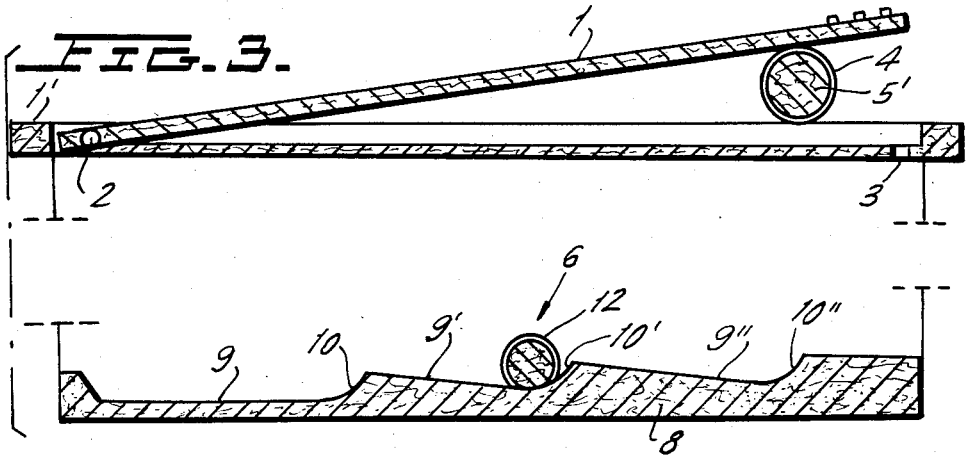
FIG. 3 is a view, partially in cross-section, taken at arrows III, III in FIG. 2 and depicting the adjustment mechanisms for the writing surface and for the footrest of the present invention.

Referring to the drawings, and in particular to FIGS. 2 and 3, there is illustrated a writing table having a working surface 1, which is preferably countersunk into a fixed working plate 1'. Countersunk working surface 1 is preferably formed by being cut out of working plate 1'. Working surface 1 is attached to working plate 1' by tenon fastenings 2 situated on the front of the working surface on either side thereof.

Working surface 1 is inclined towards the user by positioning a cylindrically shaped roller 4 between the working surface and working plate 1'. The roller 4 is longer than the width of the working surface, as viewed from the front. When roller 4 is absent from the position illustrated in FIG. 3, for example, the rear of working surface 1 may be lifted by the user inserting his fingers, or like objects, through a pair of holes 3 in working plate 1' respectively located beneath the left rear and right rear portions of countersunk working surface 1, as viewed from the front of the table.

Rubber rings 5 and 5' are placed on the sides of roller 4, with rubber ring 5 being mounted on the side of roller 4 away from countersunk working surface 1 and rubber ring 5' being mounted on the side of roller 4 that is toward, but below the working surface 1. The setting of rubber rings 5 and 5' on roller 4 is implemented by countersinking or grooving roller 4 and placing the rubber rings under tension in the resulting grooves. Rubber rings 5 and 5' project outwardly from their respective grooves (not shown) so that smooth rotation of roller 4 on working plate 1' and a stable positioning of the working surface 1 at a chosen angle are secured.

When sitting at the writing table of the present invention, a user 10 may repeatedly select a desired angle of inclination of working surface 1 by moving roller 4 toward or away from the user or by removing roller 4 altogether.

Figures 1A, 1B, 1C:
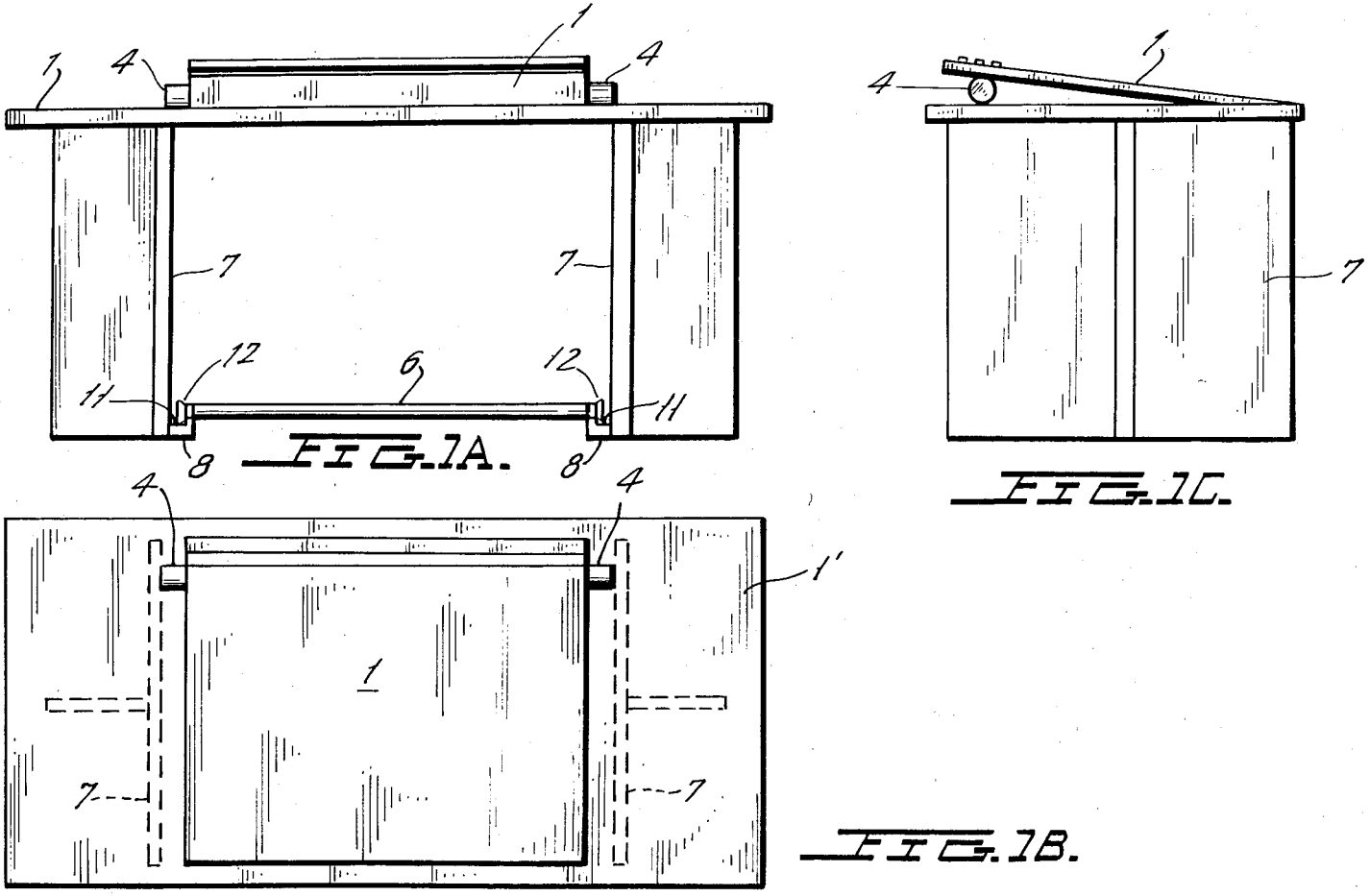
FIGS. 1A, 1B and 1C are front, top and side plan views of a writing table in accordance with the present invention.

Referring again to the drawings and in particular to FIGS. 2 and 3, a foot-roller 6 serves as a footrest. Profiles 8 (see especially FIG. 1A) are mounted on the confronting or inner sides of table rests 7 for carrying the foot-roller 6. The profiles 8 ascend in three horizontal stages 9, 9' and 9'' from the front to the rear of the profiles. Horizontal stages 9' and 9'' are inclined downwardly from the front to the rear in order to facilitate smooth rotation of the foot roller rearwardly up to the beginning of a next stage. Vertical stages 10, 10' and 10'' are included in profiles 8, ascent flatwise and arch to the rear so as to provide a smooth transport of the footrest up to the next stage when adjustment is desired, while providing a stable support at the stages 10, 10' and 10'' when a fixed position of the footrest is desired.

As shown in FIG. 2, profiles 8 are equipped with respective grooves 11 (only one of which is shown in FIG. 2) along the entire length. Cooperating with grooves 11 are circular disks 12 on both ends of foot-roller 6 (only one disk being shown in FIG. 2). The disks are bevelled on their confronting or inner sides and run in respective grooves 11 of profiles 8. A pair of rubber rings 13, one at either end of the foot-roller 6 and disposed inwardly of rubber rings 13 allow smooth and silent gliding of the foot-roller 6 forwards and backwards on profiles 8.

By stretching out or drawing up his legs, a user can easily move the foot-roller of the present writing table or bring it to different heights, with the foot-roller finding stable support through forward pressure of the user's legs at the vertical stages 10, 10' and 10'' (FIG. 3) of profiles 8. The foot-roller can be adjusted to different positions by a user without the need for the user's hands or for complicated technical equipment.

The provision of the table-roller beneath the working surface of the writing table gives a user the opportunity to continuously vary the angle of inclination of the working surface over a wide range by using an uncomplicated mechanical system.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A writing table comprising:

a working plate having an upper surface with a countersunk opening in it;

a working surface countersunk into the working plate opening, the working surface comprising a cutout portion of the working plate and having front and rear portions with respect to a user;

hinge means at the front of the working surface and in the countersunk opening for rotatably supporting the front of the working surface with respect to the working plate and for continuously varying the inclination of the working surface from being coplanar with the working plate to a maximum angle of inclination;

a table-roller situated beneath the working surface and rollable to various positions beneath the working surface for supporting the rear of the working surface at different elevations above the plate, whereby different inclinations of the working surface may be provided;

a foot support member comprising a foot-roller extending from left to right from the perspective of the user; and positioning means for adjusting the vertical position of the foot support member and the position of the foot support member towards and away from the user through manipulation by a user's foot, said positioning means comprising a pair of profile members situated to the left and right of a user, said profile members each comprising a plurality of generally-horizontal stages ascending from front to rear from the user's perspective, with a respective, generally-vertical portion being interposed between adjacent horizontal stages, the ends of said foot-roller being adapted to rotate on said profile members under force of a user's foot.

2. The writing table of claim 1, wherein the table-roller is longer than the width of the working surface and the opening from the perspective of the user, and the table-roller sits on and rotates on the upper surface of the working plate.

3. The writing table of claim 2, wherein each end of the table-roller has two countersunk rubber rings, with an outer ring positioned above the upper surface of the working plate and an inner ring positioned beneath the working surface.

4. The working table of claim 1, wherein the hinge means comprises respective tenon fasteners at the left and right sides of the working surface.

5. The writing table of claim 1, wherein the profile members are each provided with a respective roller-guide groove extending from front to rear from the user's perspective, and the foot-roller is provided with respective disks at each of its ends, the disks being adapted to be received in and guided by the roller-guide grooves of the profile members.

6. The article of furniture of claim 1, wherein a pair of rubber rings are provided on the foot-roller inwardly of the disks and are positioned so that each ring rides on a respective profile member.

7. The article of furniture of claim 1, wherein at least one of the generally-horizontal stages of the profile members comprises a flat portion inclining downwardly from front to rear and wherein the adjacent generally vertical portion immediately to the rear comprises a flat portion inclining upwardly and rearwardly.

* * * * *